United States Patent [19]

Avari

[11] Patent Number: 5,044,260

[45] Date of Patent: Sep. 3, 1991

[54] AIR DISTRIBUTION UNIT

[75] Inventor: S. Richard Avari, Garden City, N.Y.

[73] Assignee: CTS Consolidated Technical Services, Inc., Garden City, N.Y.

[21] Appl. No.: 541,636

[22] Filed: Jun. 21, 1990

[51] Int. Cl.[5] ..... F24F 13/075

[52] U.S. Cl. ..... 98/40.28; 98/40.20

[58] Field of Search ..... 98/40.28, 31.6, 31.5, 98/40.2, 40.21, 40.26

[56] References Cited

U.S. PATENT DOCUMENTS

| | | | |
|---|---|---|---|
| 1,756,997 | 5/1930 | Shurtleff . | |
| 2,141,403 | 12/1938 | Offen . | |
| 2,182,690 | 12/1939 | Cole . | |
| 2,262,261 | 11/1941 | Smith . | |
| 2,324,858 | 7/1943 | Levine . | |
| 2,467,309 | 4/1949 | Hart et al. | 98/40.28 |
| 2,630,054 | 3/1953 | Peterson | 98/40.2 |
| 2,852,235 | 9/1958 | McElgin et al. . | |
| 2,868,402 | 1/1959 | Melgaard | 98/40.28 |
| 2,928,333 | 3/1960 | Madison . | |
| 3,065,685 | 11/1962 | Sylvester et al. | 98/40.28 |
| 3,111,075 | 11/1963 | Hoyle et al. . | |
| 3,112,623 | 12/1963 | Crossman . | |
| 3,252,397 | 5/1966 | Horst et al. . | |
| 3,333,525 | 8/1967 | Tischuk . | |
| 3,340,787 | 9/1967 | Phillips | 98/40.28 |
| 3,831,395 | 8/1974 | Levy . | |
| 4,334,899 | 6/1982 | McConnell . | |
| 4,480,533 | 11/1984 | Bolton et al. . | |
| 4,619,030 | 10/1986 | Marwick et al. . | |
| 4,633,770 | 1/1987 | Taylor et al. . | |
| 4,693,176 | 9/1987 | Deeg et al. . | |
| 4,730,551 | 3/1988 | Peludat . | |
| 4,777,870 | 10/1988 | Bolton et al. . | |
| 4,854,376 | 8/1989 | Tunekawa et al. . | |

FOREIGN PATENT DOCUMENTS

| | | | |
|---|---|---|---|
| 0086842 | 5/1984 | Japan | 98/40.28 |

OTHER PUBLICATIONS

*Mitsubishi*, "MS/MSh series", p. 3.
*Mitsubishi*, "PC/PCH-AG series", p. 6.
*Sanyo*, "Floor Mounted-Ductless Split Heat Pumps", p. 12.
*Sanyo*, "Ceiling Suspended-Ductless Split Air Conditioners", p. 14.
*Sanyo*, "Wall Mounted-Ductless Split Heat Pumps", p. 10.

*Primary Examiner*—Albert J. Makay
*Assistant Examiner*—W. Doerrler
*Attorney, Agent, or Firm*—Scully, Scott, Murphy & Presser

[57] ABSTRACT

An air distribution unit comprising a housing and louvered inlet and outlet grilles. The housing forms an interior space, an inlet for conducting air into that interior, and an outlet for discharging air from the air distribution unit; and the inlet and outlet grilles are located in the inlet and outlet of the housing, respectively. These grilles have identical shapes and identical sizes and each grille includes a multitude of parallel louvers that are held in fixed positions in the grille. Moreover, the inlet grille has first and second positions to help direct air into the interior of the housing at first and second inlet angles respectively, and the outlet grille has first and second positions for directing air from the interior of the housing at first and second outlet angles respectively.

8 Claims, 5 Drawing Sheets

AIR DISTRIBUTION UNITBACKGROUND OF THE INVENTION

This invention generally relates to air distribution units of the type commonlY used in air-conditioning, heating or ventilation systems.

In many commercial air-conditioning, heating and ventilation systems, treated air is discharged into an area to be conditioned through an air distribution or conditioning unit. For example, one general tYpe of air-conditioning system, often referred to as a split system, includes separate indoor and outdoor units. The outdoor unit includes a compresser, a heat exchanger and a fan, and the indoor unit includes a heat exchanger and a fan. In operation, the indoor fan draws air into the indoor unit, through an inlet thereof, and forces the air over the indoor heat exchanger and then out of the indoor unit, through an outlet opening therein.

The outdoor fan draws air into the outdoor unit, through an inlet thereof, forces that air over the outdoor heat exchanger, and then forces that air out of the outdoor unit, through an outlet therein. At the same time, the compressor causes a refrigerant fluid to circulate through and between the indoor and outdoor heat exchangers. At the indoor heat exchanger, the refrigerant absorbs heat from the air passing over that heat exchanger, cooling that air; and at the outdoor heat exchanger, the air passing over the heat exchanger absorbs heat from the refrigerant passing therethrough. Typically, a louvered diffuser assembly is disposed over the outlet of the indoor unit to help direct the air discharged from that unit at a given angle.

Commonly, the indoor unit of a split system is mounted on the floor of a room, adjacent or against a wall thereof. In many situations, though, it is desirable to place the indoor unit in other locations, such as on the ceiling of the room, or on the wall at a position above the floor.

The preferred angle for discharging air from the indoor unit depends on the specific location of that unit. For example, when the air distribution unit is located on the floor of a room and adjacent a wall thereof, it is generally preferred to discharge the air at an angle of about 15° to the vertical; and when the air distribution unit is mounted on the wall of a room, between the floor and ceiling of the room, it is generally preferred to discharge the air from the unit at an angle of about 45° to the vertical. When the air distribution unit is mounted on the ceiling of a room, spaced from the walls thereof, it is generally preferred to discharge the air from the unit at an angle of about 105° to the vertical.

Thus, the preferred angles of the outlet louvers of an indoor air distribution unit vary depending on the specific location of the indoor unit in a room; and in fact, these preferred angles may vary over a comparatively large range. Most prior art air distribution units are designed to be used at only one of the above-mentioned general locations; and when they are used at other locations, the louvers of the outlet diffuser may not be positioned at the preferred angles. One arrangement for increasing the flexibility of an air distribution unit is to provide a multitude of louvered diffuser designs for the unit. One design is used on the unit when it is placed on the floor of a room, a second diffuser is used when the air distribution unit is mounted on the wall of a room, and a third diffuser design is used when the air distribution unit is mounted on the ceiling of a room. With this arrangement, the outlet louvers of the air discharge unit may be located at the preferred angles at each of the above-mentioned locations of the air distribution unit. However, the manufacture and use of the multitude of diffuser designs is burdensome and costly.

In addition to the foregoing, in most air distribution units, a grille is disposed over the inlet of the unit, and this grille has a design that is different than the diffuser assembly disposed over the outlet of the unit. This also increases the number of different parts that must be made for the air distribution unit.

SUMMARY OF THE INVENTION

An object of this invention is to improve air distribution units.

Another object of the present invention is to provide an air distribution unit that can be located on the floor, the wall or the ceiling of a room, and that has outlet louvers that can be easily positioned at optimum angles for each of these locations.

A further object of this invention is to use a single louvered assembly design for both the inlet grille and the outlet diffuser of an air distribution unit, where that louvered assembly includes a multitude of louvers that are held in stationary positions on the assembly, while still being able to position the inlet and outlet louvers at optimum angles for each of a multitude of locations of the air distribution unit.

These and other objectives are attained with an air distribution unit comprising a housing and louvered inlet and outlet grilles or diffusers. The housing forms an interior space, an inlet for conducting air into that interior, and an outlet for discharging air from the air distribution unit, and the inlet and outlet grilles are located in the inlet and outlet of the housing, respectively. These grilles have identical shapes and identical sizes, and each grille includes a multitude of parallel louvers that are held in fixed positions in the grille. Moreover, the inlet grille has first and second positions to help direct air into the interior of the housing at first and second inlet angles respectively; and the outlet grille also has first and second positions for directing air from the interior of the housing at first and second outlet angles respectively.

More specifically, the housing includes top, bottom, front, back, left side and right side members connected together to define an interior space. The top member of the housing forms a front edge, the front member of the housing forms top and bottom edges and the bottom member of the housing forms a front edge. The front edge of the bottom housing member and the bottom edge of the front housing member form the inlet of the housing, and the front edge of the top housing member and the top edge of the front housing member form the outlet of the housing.

Each of the inlet and outlet grilles has first and second longitudinally extending sides, and includes at least one transverse frame member and a multitude of parallel louvers. The transverse frame member, in turn, has first and second legs; and the first leg extends from the first longitudinally extending side of the grille to a position generally mid-way between the first and second sides of the grille, and the second leg of the transverse frame member extends generally from that mid-way position to the second longitudinally extending side of the grille. The multitude of parallel louvers of each grille have a elongated, flat, thin shape, and these multitude of louvers include a first set of louvers rigidly connected to the first leg of the frame member and held in fixed positions relative thereto, and a second set of louvers rigidly connected to the second leg of the frame member and held in fixed positions relative to that second leg.

The inlet grille extends downwardly and rearwardly from a location at least adjacent the bottom edge of the front member of the housing to a position at least adjacent the front edge of the bottom member of the housing. In the first position of the inlet grille, the first and second longitudinal sides of that grille are located adjacent the bottom edge of the front member of the housing and the front edge of the bottom member of the housing, respectively, and the inlet grille directs air into the interior of the housing at the first inlet angle. In the second position of the inlet grille, the first and second longitudinal sides of that grille are located adjacent the front edge of that bottom member and the bottom edge of that front member, respectively, and the grille directs air into the interior of the housing at the second inlet angle.

The outlet grille extends forwardly and downwardly from the front edge of the top member of the housing to a position at least adjacent the top edge of the front member of the housing. In the first position of this grille, the first and second longitudinal sides of the grille are respectively adjacent the front edge of the top memoer of the housing and the top edge of the front member of the housing, and the louvers of the grill direct the air discharged from the housing at the first outlet angle. In the second position of the outlet grille, the first and second longitudinal sides of the grille are respectively adjacent the top edge of that front member and the front edge of that top member and the louvers of the grille direct the air discharged from the housing at the second outlet angle.

Thus, with the housing and grille design of the present invention, four different combinations of inlet and outlet louver angles are possible. A first combination is produced when both the inlet and outlet grilles are in their first of the above-described positions, and a second combination is produced when the inlet grille is in its first position and the outlet grille is in its second position. A third combination of louver angles is produced when the inlet grille is in its second position and the outlet grille is in its first position, and a fourth combination is produced when both the inlet and outlet grilles are in their second of the above-described positions. The first of these combinations produces the optimum inlet and outlet louver angles when the air distribution unit is mounted on the floor or a ceiling of a room, and the fourth of these combination of angles produces the desirable or optimum angles when the air distribution unit is mounted on the wall of a room.

The air distribution unit may also be provided with a heat exchanger and a fan for forcing air over that heat exchanger. In operation, a heated or chilled fluid is circulated through the heat exchanger. At the same time, the fan draws air into the housing from the area or space immediately outside that housing, forces that air over the heat exchanger, heating or cooling that air, and forces the treated air through the housing outlet and back into the area or space immediately outside the housing.

Further benefits and advantages of the invention will become apparent from a consideration of the following detailed description given with reference to the accompanying drawings, which specify and show preferred embodiments of the invention.

DETAILED DESCRIPTION OF THE PREFERRED EMBODIMENTS

Figure 1:
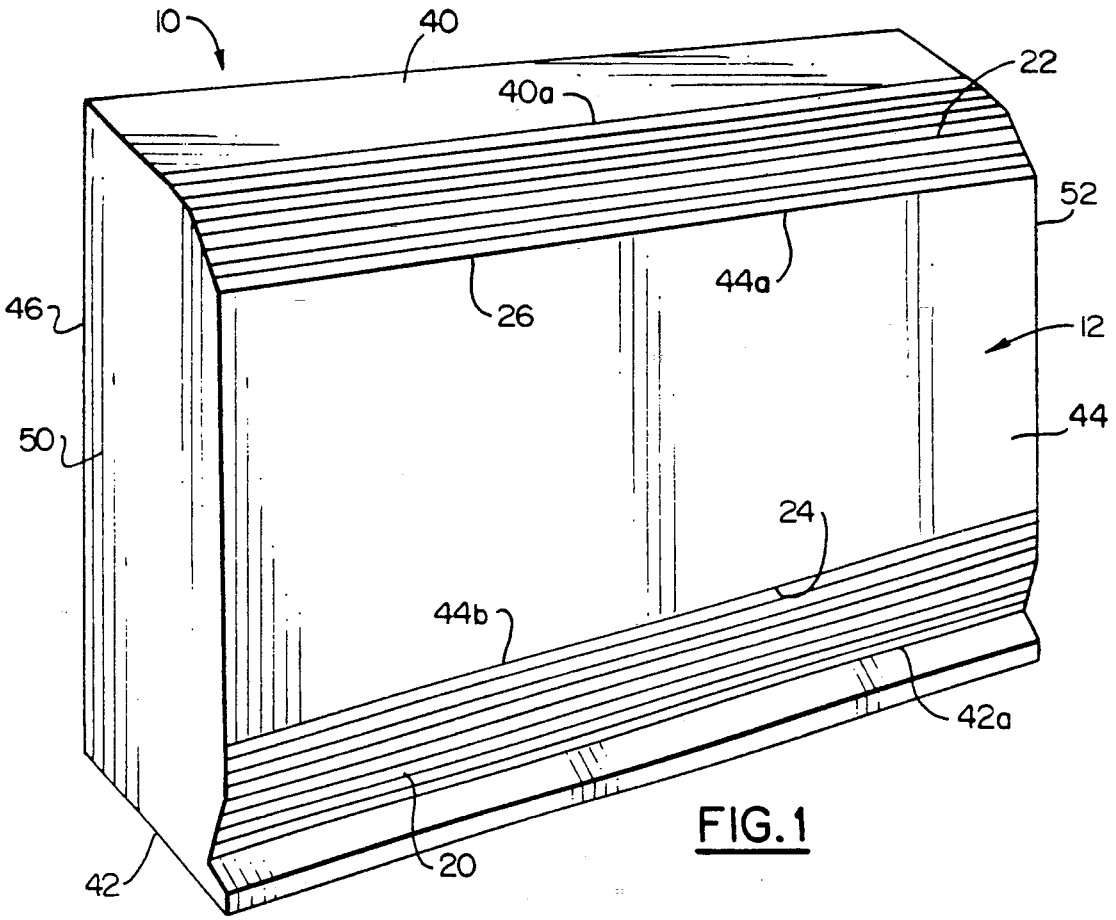
FIG. 1 is a perspective view of an air distribution unit according to the present invention.
Figure 2:
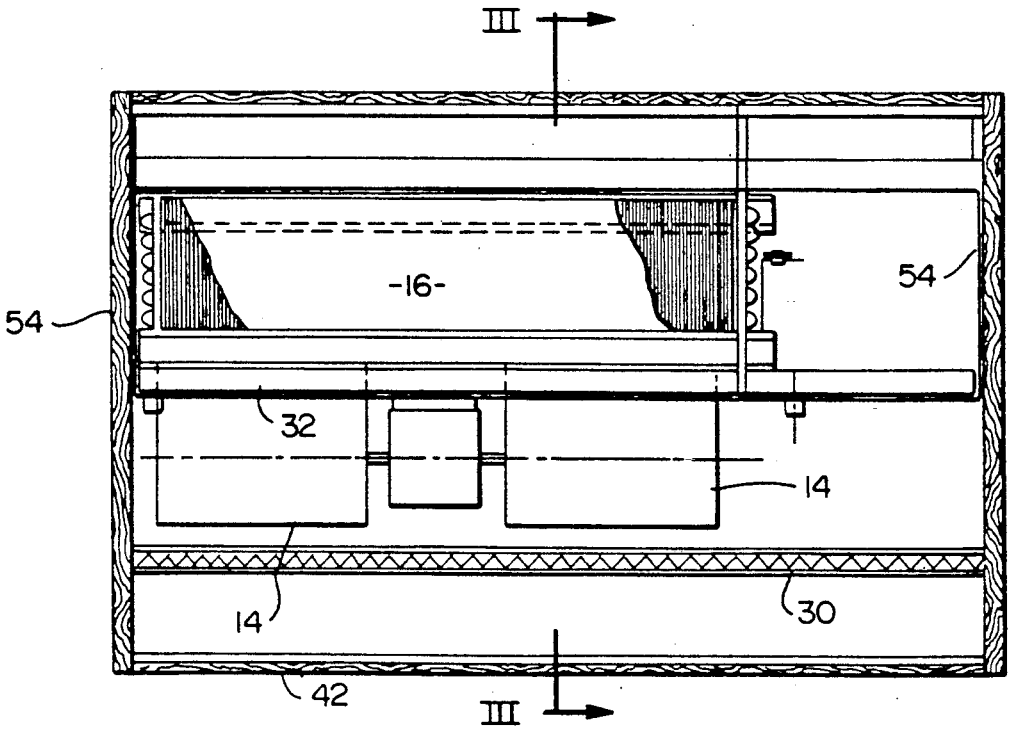
FIG. 2 is a front, sectional view of the air distribution unit, taken along line II—II of FIG. 3.
Figure 4:
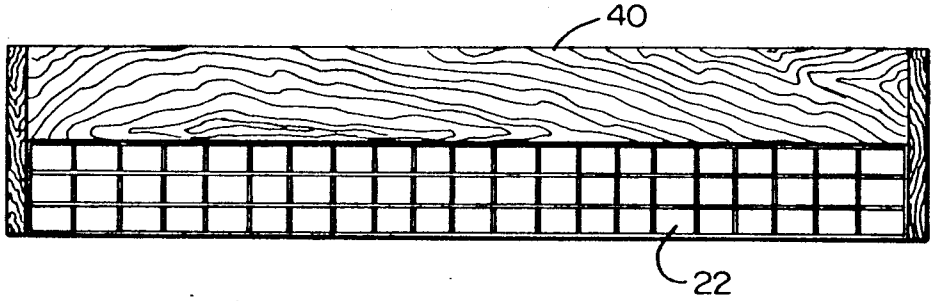
FIG. 4 is a top view of the air distribution unit.

FIGS. 1 through 4 illustrate air distribution unit 10 generally comprising casing or housing 12, fans 14, heat exchanger 16, inlet grille 20 and outlet grille or diffuser 22. Generally, housing 12 forms an interior space, an inlet 24 for conducting air into that interior and an outlet 26 for discharging air from the interior of the housing. Fans 14 and heat exchanger 16 are secured inside housing 12; and inlet and outlet grilles 20 and 22 are secured over or in the housing inlet 24 and outlet 26 respectively. It should be noted that the word grille is used herein in a general sense to refer to both the member 20 placed in housing inlet 24 and the member 22 placed in housing outlet 26; and one or both of the members 20 and 22 may be referred to by other names such as diffuser, louver assembly or air directing device without departing from the present invention.

In operation, a heated or chilled fluid is circulated through heat exchanger 16. At the same time, fan 14 draws air into housing 12 from the area or space immediately outside the housing, forces that air over heat exchanger 16, heating or cooling the air, and forces the treated air through housing outlet 26 and back into the area or space immediately outside the housing. A filter 30 may be disposed in housing 12 to filter the air passing therethrough; and a drip pan 32 may be secured in the housing, below heat exchanger 16, to collect water that condenses on and drips downward from heat exchanger 16.

Preferably, fans 14 are centrifugal fans secured in the lower half of unit 10; and heat exchanger 16 is an air-water or air-refrigerant heat exchanger secured in the upper half of unit 10, above the fans 14. Heat exchanger 16 may be, for example, comprised of a multitude of coils or tubes that are part of a closed fluid circuit, and a multitude of heat transfer plates or fins mounted on those coils or tubes. Numerous suitable fans and heat exchangers are well known in the art and may be employed in unit 10, and it is unnecessary to describe fans 14 or heat exchanger 16 further herein.

Housing 12 includes top member 40, bottom member 42, front member 44, back member 46, left side member 50 and right side member 52 connected together to define an interior space, inlet 24 and outlet 26. More specifically, the housing top member forms front edge 40*a*, the housing front member forms top and bottom edges 44*a* and 44*b*, and the housing bottom member forms front edge 42*a*. Front edge 42*a* is located below and rearward of bottom edge 44*b*, and these two edges define inlet 24; and front edge 40*a* is located above and rearward of top edge 44*a*, and these two edges define outlet 26. Preferably, each of the edges 40*a*, 42*a*, 44*a* and 44*b* is substantially linear and transversely extends completely or substantially completely across housing 12, between the left and right side members 50 and 52 thereof.

Moreover, each of members 40, 42, 44, 46, 50 and 52 has a substantially thin, planar shape, and these members of the housing are connected together to form a closed body having a generally rectangular cross-section and having lower and upper front corners that form inlet 24 and outlet 26, respectively. In addition, though, with reference to FIGS. 8–11, front member 44 includes an upwardly and rearwardly extending upper lip 44*c*, a back lip 44*d* that extends downwardly from the top edge of lip 44*c*, and that forms edge 44*a*, and a rearwardly extending bottom lip 44*e* that forms bottom edge 44*b*. Top member 40 forms a downwardly and rearwardly extending front lip 40*b* that forms front edge 40*a*, and bottom member 42 forms an upwardly extending front lip 42*b* and a lip 42*c* that extends upwardly and rearwardly from the top of front lip 42*b*. Also, preferably, the inside surfaces of the housing are lined with a thermal and sound insulating material 54.

Housing 12 may be made from any suitable material; and, for example, the housing members may be made from thin metal sheets and these members may be riveted or screwed together. Alternatively, a plurality of the housing members may be stamped from one sheet of material; and, for instance, the back and side wall members 46, 50 and 52 of the housing may be stamped from one sheet of material.

Figure 5:
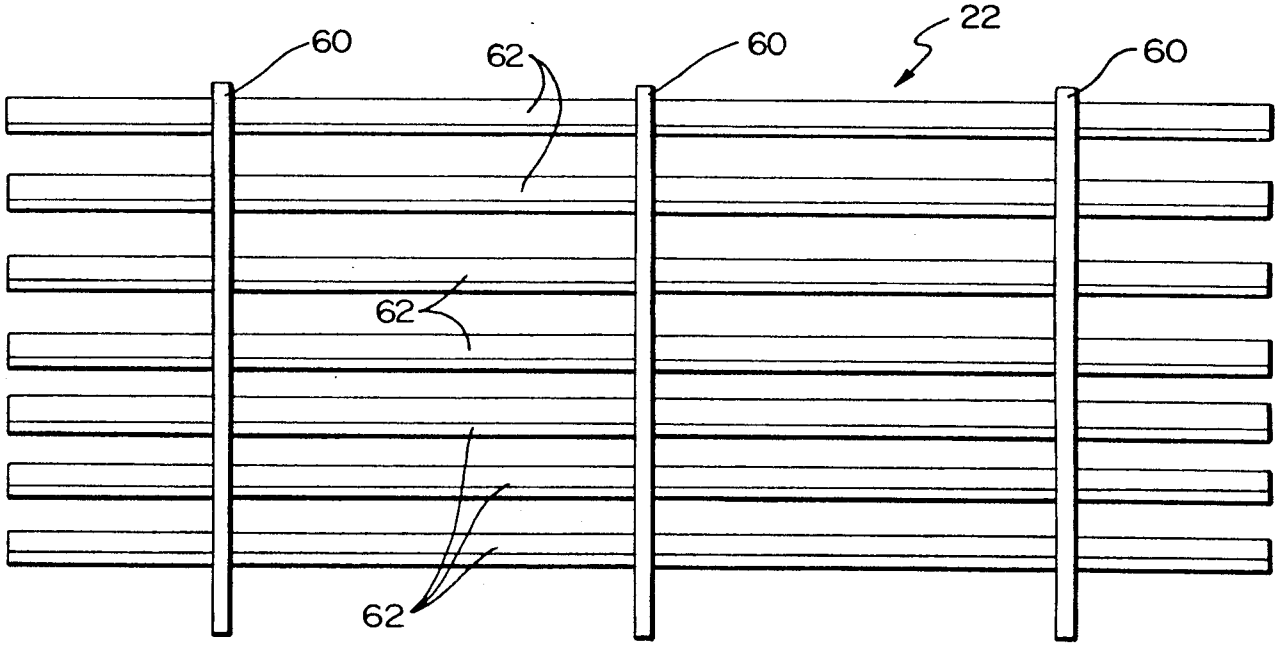
FIG. 5 is a top view of one section of the outlet grille of the air distribution unit.
Figure 3:
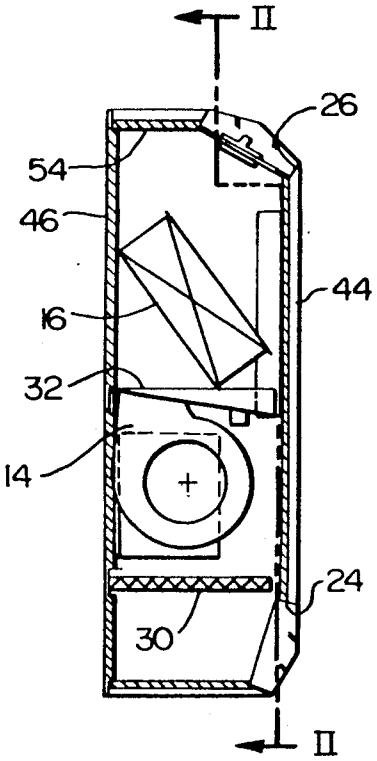
FIG. 3 is a side, sectional view of the air distribution unit, taken along line III—III of FIG. 2.

Inlet and outlet grilles 20 and 22 have identical shapes and sizes, and preferably each of these grilles comprises a plurality of separate but identical grille sections positioned next to each other along the length of the grille. One of these sections of the outlet grille is shown in FIG. 5 at 22*a*. With reference to this Figure, the outlet grille section includes at least one, and preferably a plurality of, transverse frame members 60, and a multitude of longitudinal louvers 62. Moreover, grille section 22*a* has first and second longitudinally extending sides and first and second transversely extending sides; and preferably transverse members 60 are parallel to each other, and louvers 62 are parallel to each other.

Figure 6:
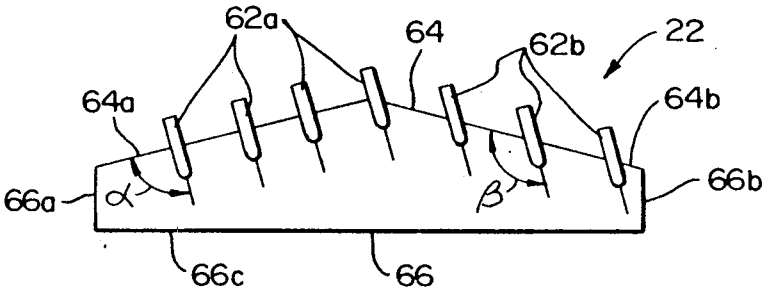
FIG. 6 is a side view of the outlet grille.

With the embodiment of grille section 22*a* shown in FIG. 5, frame members 60 are substantially identical, and hence only one will be described in detail. With reference now to FIGS. 5 and 6, each of these frame members include top section 64 having first and second legs 64*a* and 64*b*; and preferably each frame member further includes bottom section 66 having first leg 66*a*, second leg 66*b* and third leg 66*c*. First leg 64*a* of the frame member extends from a first longitudinally extending side of the grille to a position substantially midway between the longitudinally extending sides of the grille, and second leg 64*b* extends from that mid-way position to the second longitudinally extending side of the grille; and furthermore, preferably, the top section 64 of frame member 60 is substantially symmetrical about its own longitudinal center point.

Bottom section 66 of the frame member, generally, is connected to and extends across the ends of frame top frame section 64 to form, with that section, a sturdy, rigid support member for grille 22. In particular, bottom section 66 has a U-shape; and first leg 66*a* is connected to and extends from a first end of top section 64, second leg 66*b* is connected to and extends from a second end of the top frame section, and third leg 66*c* is connected to and extends between ends of legs 66*a* and 66*b*. Frame member 60 may also be made in any suitable way and from any suitable materials. For example, the frame member may be formed from a single, elongated piece of metal, which is folded or bent into the desired shape, with ends of that elongated piece then connected together such as by welding. Alternatively, top frame section 64 may be made from a first piece of material, bottom section 66 may be made from a second piece of material, and these two pieces may be connected together to form frame member 60, or the frame member may be stamped from a solid piece of metal or molded from plastic.

Figure 7:
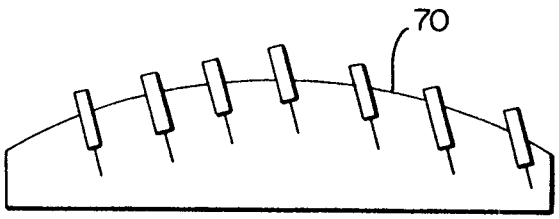
FIG. 7 illustrates an alternate frame member that may be used in the inlet and outlet grilles.

As particularly illustrated in FIG. 6, the top section of frame member 60 has a v-shape, and legs 64*a* and 64*b* form an obtuse angle. Preferably, these legs intersect at an angle between about 140° and 160°, and even more preferably, these legs intersect at an angle of about 150°. The top section of frame member 60 may have other shapes, however; and, for example, FIG. 7 shows an alternate top section 70 having a smooth, curved shape.

Each of the louvers 62 has a thin, flat elongated shape, and these louvers are connected to frame members 60 and longitudinally extend across grille 22; and preferably, the louvers are parallel to each other and are uniformly spaced apart in the transverse direction of grille 22. More specifically, a first set of louvers 62*a* are rigidly connected to and held in fixed positions relative to leg 64*a* of frame 60, and a second set of louvers 62b are rigidly connected to and held in fixed positions relative to second leg 64*b* of the support frame. With the embodiment of grille 22 shown in FIGS. 5 and 6, all of the first set of louvers 62*a* form an equal, first angle $\alpha$ with the leg 64*a* of the frame member; and all of the second set of louvers 62*b* form an equal, second angle $\beta$ with leg 64*b* of the frame member. Also, with this embodiment of the grille, these angles $\alpha$ and $\beta$ are different from each other. Preferably, the first angle $\alpha$ is between about 85° and 95°, and the second angle $\beta$ is between about 115° and 125°; and even more preferably, $\alpha$ is approximately 90° and $\beta$ is approximately 120°.

With the embodiment of grille section 22*a* shown in FIG. 5, each louver 62 is comprised of one integral piece of material that fits into small, aligned slots formed in the frame members 60 of the grille section. Alternatively, each louver of the grille section may itself be comprised of a plurality of separate, aligned sections, each of which is secured to one or more of the transverse frame members of the grille section. For example, a first section of each louver may extend from the left end of the grille section, as viewed in FIG. 5, to a first transverse frame member 60, and a second section of each louver may extend between first and second frame members 60 of the grille section.

A third section of each louver may extend between second and third frame sections of the grille section, and a fourth section of each louver may extend between that third frame section and the right end of the grille section. As will be appreciated by those of ordinary skill in the art, the louvers of grille 22 may have more or fewer than the four sections described herein, without departing from the present invention. Louvers 62 may be made from thin, flat metal sheets and connected to frame members 60 by welding or brazing. As will be understood by those of ordinary skill in the art, however, louvers may be made from other materials and may be connected to frame members in other ways.

Again, with reference to FIGS. 8–11, outlet grille 22 can be positioned in outlet 26 of housing 12 in either one of two positions; and similarly, inlet grille 20 can be positioned in inlet 24 of the housing in either one of two positions. In both of these positions of the outlet grille, the grille extends forwardly downwardly from, or adjacent from, edge 40*a* to or adjacent to edge 44*a*; and in both of the positions of the inlet grille, the grille extends downwardly rearwardly from, or adjacent a location adjacent, edge 44*b* to, or adjacent to edge 42*a*.

Figure 9:
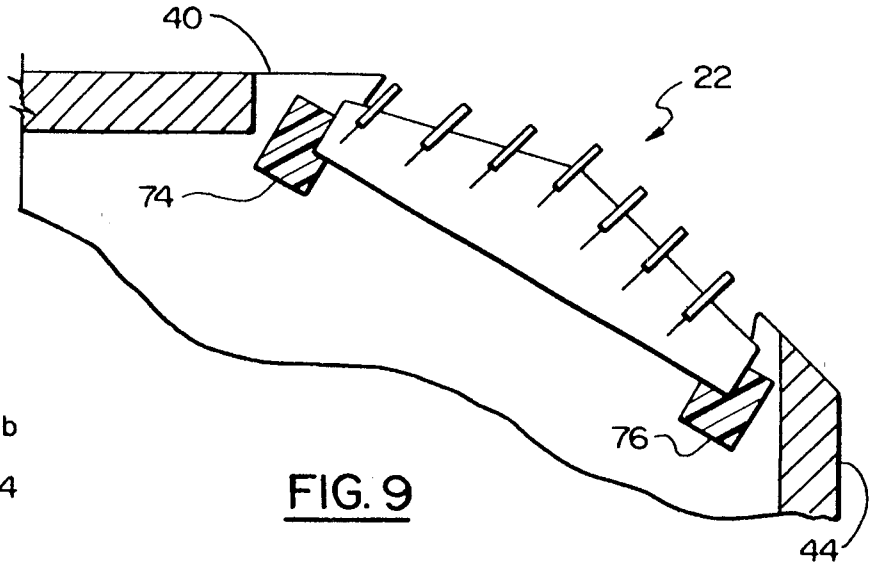
FIG. 9 is similar to FIG. 8, but with the outlet grille in a second position.
Figure 8:
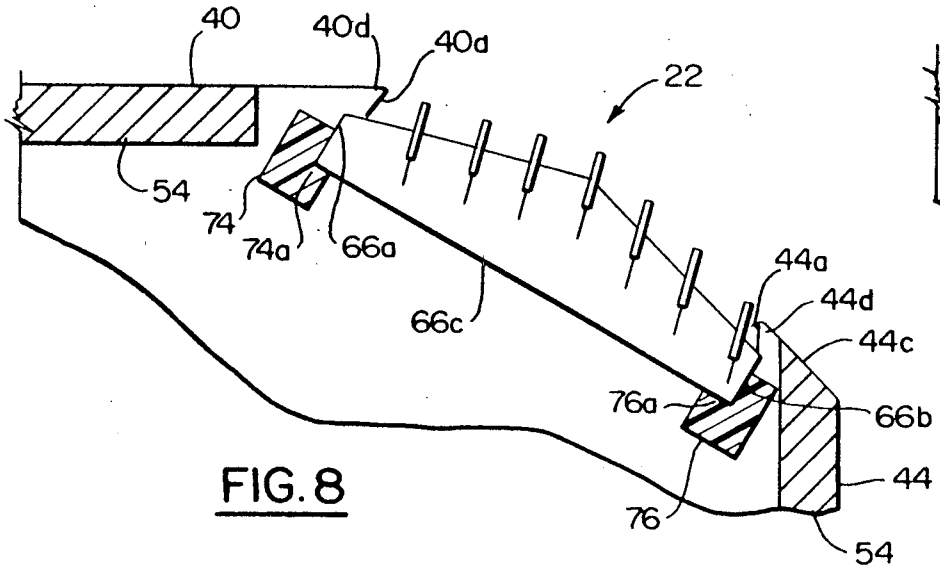
FIG. 8 is a cross-sectional view of an upper front portion of the air distribution unit, showing the outlet grille in a first position.

More specifically, in the first position of the outlet grille, shown in FIG. 8, the first and second longitudinally extending sides of the grille are respectively adjacent the front edge 40*a* of housing top member 40 and top edge 44*a* of housing front member 44; and in the second position of the outlet grille, shown in FIG. 9, the first and second longitudinally extending sides of the grille are respectively adjacent edges 44*a* and 40*a*. Moreover, preferably, in both positions of the outlet grille, the outer ends of the set of louvers that are adjacent to top edge 44*a* are co-planar with the plane defined by lip 44*c* of housing member 44, and the leg of frame top section 64 that is adjacent this top edge is parallel to that lip 44*c*. With the embodiment of.the grille 22 shown in FIGS. 8 and 9, when the grille is in its first position, louvers 62 extend at an angle of about 15° to the plane defined by front member 44; and when the grille is in its second position, louvers 62 extend at an angle of about 45° to that plane. When a frame member 60 having a curved top section 70, as shown in FIG. 7, is used in the outlet grille of unit 10, that top section curves forwardly downwardly from, or from a portion adjacent, edge 40*a* to edge 44*a* or to a position adjacent thereto.

Figure 10:
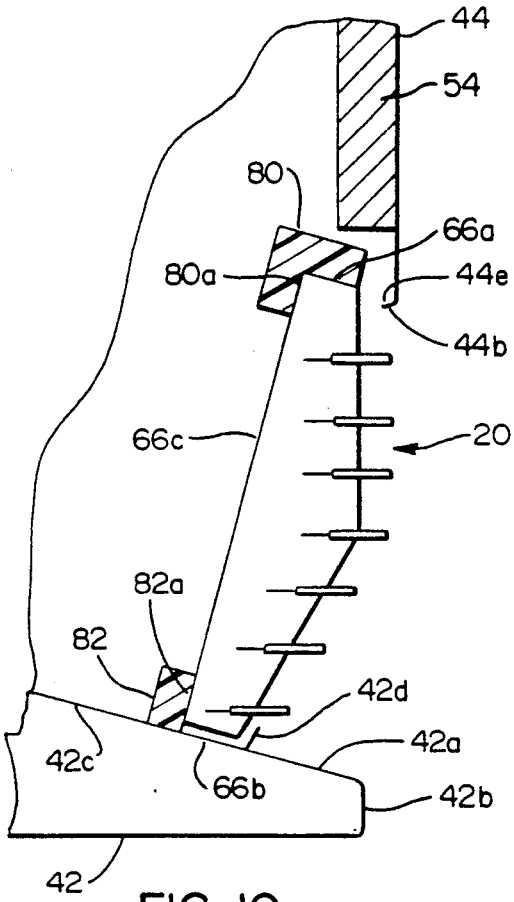
FIG. 10 is a cross-sectional view of a lower front portion of the air d.istribution unit, showing the inlet grille thereof in a first position.
Figure 11:
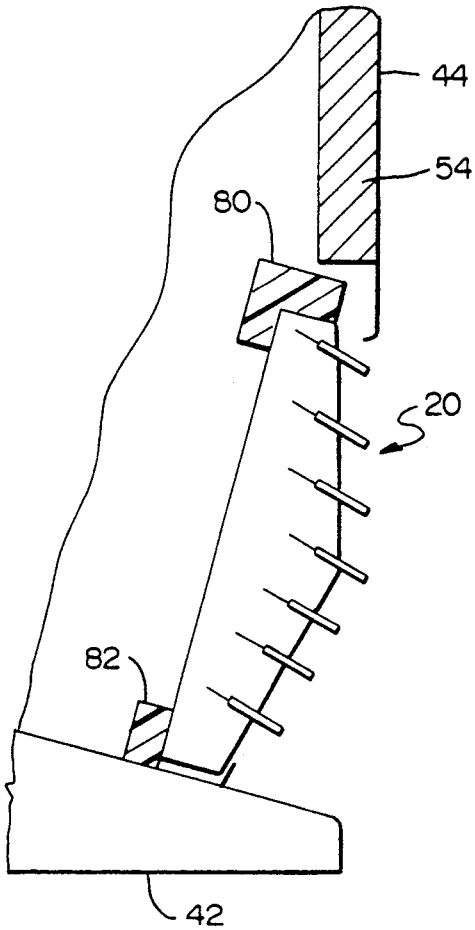
FIG. 11 is similar to FIG. 10, but with the inlet grille in a second position.

In the first position of the inlet grille 20, shown in FIG. 10, the first and second longitudinally extending sides of the grille are respectively adjacent the front edge 42*a* of housing bottom member 42 and the bottom edge 44*b* of housing front member 44; and in the second position of the inlet grille, shown in FIG. 11, the first and second longitudinally extending sides of the grille are respectively adjacent edges 44*b* and 42*a*. Further, preferably, in both positions of the grille, the outer ends of the set of louvers that are adjacent to bottom edge 44*b* are co-planar with the front housing member 44, and the leg of the top section of the inlet grille that is adjacent bottom edge 44*b* is parallel to the plane defined by housing front member 44. With the embodiment of the grille shown in FIGS. 10 and 11, when the grille is in its first position, louvers 62 extend at an angle of about 90° to the plane defined by the front member 44; and when the grille is in its, second position, louvers 62 extend at an angle of about 120° to that plane. When a frame member having a curved top section 70 is used in the inlet grille of unit 10, that top section curves downwardly rearwardly from, or from a position adjacent edge 44*b* to edge 42*a* or adjacent thereto.

Thus, with the housing 12 and grilles 20 and 22 of air distribution unit 10 of the present invention, four different combinations of inlet and outlet louver angles are possible. The first combination is produced when both the inlet and outlet grilles are in their first of the above-described positions, and a second combination is produced when the inlet grille is in its first position and the outlet grille is in its second position. A third combination of louver angles is produced when the inlet grille is in its second position and the outlet grille is in its first position, and a fourth combination is produced when both the inlet and outlet grilles are in their second of the above-described positions. The first of these combinations produces the angles that are desirable or optimal when the air discharge unit is mounted on the floor or a ceiling of a room, and the fourth of these combinations of angles produces the desirable or optimal angles when the air discharge unit is mounted on the wall of the room, spaced from both the floor and ceiling thereof.

Figure 12:
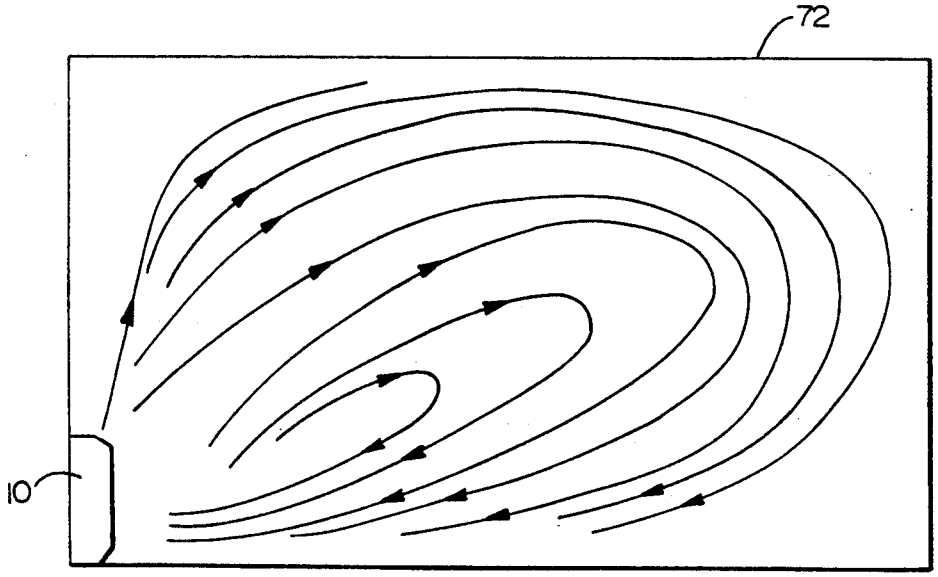
FIG. 12 schematically shows the air distribution unit in a first location in a room, and generally illustrates the air flow pattern through that room.
Figure 13:
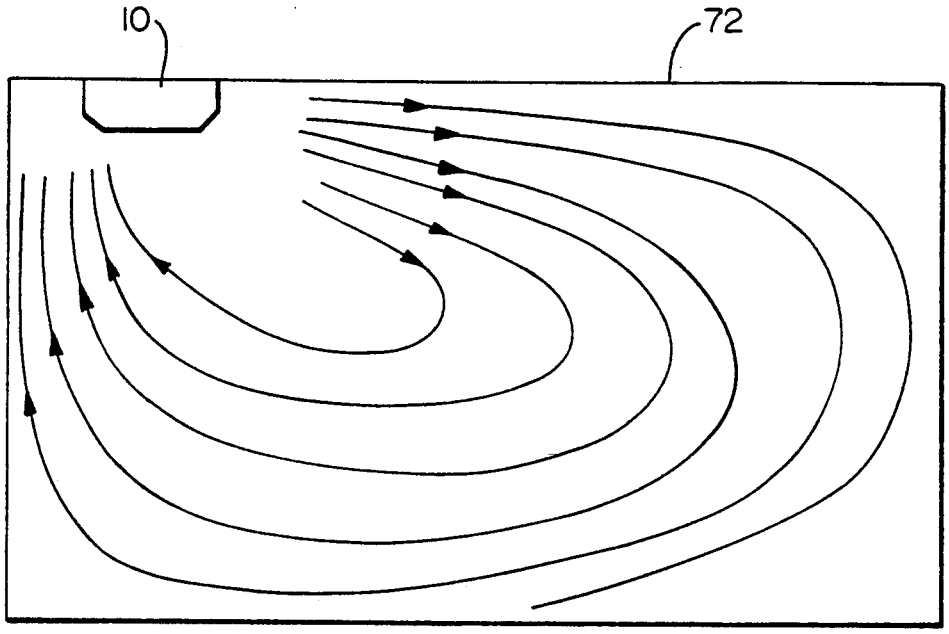
FIG. 13 is similar to FIG. 12, but with the air distribution unit mounted in a second location in the room.
Figure 14:
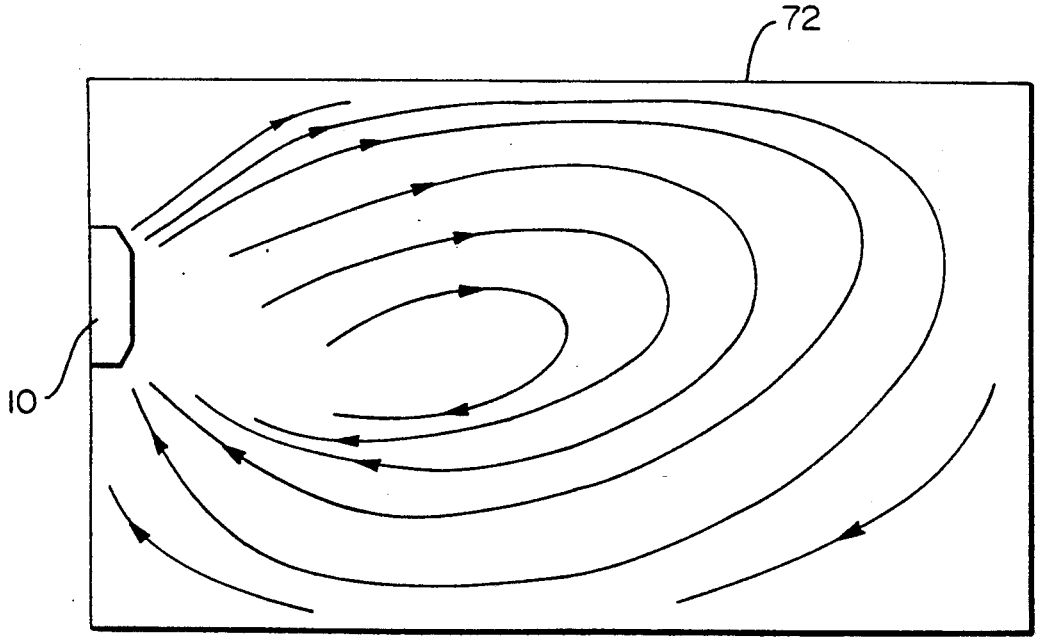
FIG. 14 is also similar to FIG. 13, but with the air distribution unit mounted in a third location in the room.

To elaborate, with reference to FIGS. 12 through 14, when air distribution unit 10 is mounted on the floor of a room 72, with the front housing member extending vertically, and with the inlet and outlet grilles mounted in their first positions, the outlet louvers extend, and direct the discharge air outward, at an angle of about 15° to the vertical, and the inlet louvers extend substantially horizontally, which is also the direction at which the indoor air is moving immediately prior to that air entering the inlet 24 of the unit. When the air distribution unit is mounted on the wall of the room 72, as shown in FIG. 14, again with the front housing member extending vertically, but with the inlet and outlet grilles in their second positions, the outlet louvers extend, and direct the discharge air outward at, an angle of about 45° to the vertical and the inlet louvers extend at an angle of about 120° to the vertical, which is the direction at which the indoor air is moving immediately prior to entering the inlet of the air distribution unit. When the air discharge unit is mounted on the ceiling of a room, as shown in FIG. 13, with the front housing member oriented horizontally, but again with the inlet and outlet grilles located in their first positions, inlet and outlet grilles located in their first positions, the outlet louvers extend, and direct the discharge air outward, at an angle of about 105° to the vertical, and the inlet louvers extend substantially vertically, which is the direction at which the indoor air is moving immediately before entering the inlet.

Inlet and outlet grilles 20 and 22 may be held in place in housing 12 in any suitable manner. For instance, again with reference to FIGS. 8 and 9, elongated strips of material 74 and 76 may be connected to housing 12, transversely extend along or adjacent the housing edges 40*a* and 44*a*, and form seats 74*a* and 76*a* for releaseably receiving and holding the outlet grille. Preferably, these elongated strips 74 and 76 are comprised of a foam or other insulating materials and also help seal the gaps between the outlet grille and adjacent portions of insulating material 54. In addition, preferably, the width of grille 22 is slightly longer than the width of outlet 26, the lips 40*b* and 44*d* of housing 12 that are immediately adjacent the outlet are at least slightly flexible, and the outlet grille is installed in the housing by snapping the grille beneath one or both of these lips. For example, the outlet grille may be installed by placing the corner formed by legs 66*a* and 66*c* in seat 74*a*, and then forcing or snapping the corner formed by legs 66*b* and 66*c* underneath lip 44*d* and into seat 76*a*.

With reference to FIGS. 10 and 11, elongated strips of material 80 and 82 may be connected to housing 12 and transversely extend along or adjacent edges 42*a* and 44*b*, and these strips may form seats 80*a* and 82*a* to releaseably receive inlet grille 20. Preferably, these strips 80 and 82 also are comprised of a foam or other insulating material and help to seal the gaps between the inlet grille and adjacent portions of insulating material 54 and bottom housing member 42. Further, preferably, the width of grille 20 is slightly larger than the width of inlet 24, the lips 42*d* and 44*e* of housing 12 that are immediately adjacent the inlet are slightly flexible, and the inlet grille is installed on the housing by forcing or snapping the grille behind one or both of lips 42*d* and 44*e*. For example, the inlet grille may be installed by placing the corner formed by legs 66*b* and 66*c* behind lip 42*d*, and then forcing or snapping the corner formed by legs 66*a* and 66*b* behind lip 44*e*.

Air distribution unit 10 may be used in a variety of ways. For example, the unit may be used a part of a vapor compression air-conditioning or heat pump system, in which unit 10 is located inside an enclosure and connected to a second unit located outside the enclosure and having a compressor and a second heat exchanger. As another example, air distribution unit 10 may be used as part of a hydronic system, in which chilled or heated water is conducted through heat exchanger 16 to cool or heat air being passed over the heat exchanger.

The preferred embodiment of air distribution unit 10 described above includes fans 14 and heat exchanger 16. Neither of these elements is necessary to the present invention in its broadest sense, however; and for example, the air distribution unit may be used, without fans 14 or heat exchanger 16, to collect air from and to discharge air into a room. To elaborate, when unit 10 is to used, room air may be drawn into housing 12 via inlet 24, and then conducted to a remote air treating or conditioning apparatus by suitable duct work. The treated air may then be returned to unit 10, and discharged therefrom via outlet 26 and back into the room.

Also, as will be appreciated by those of ordinary skill in the art, air distributiron unit 10 may be provided with elements or apparatus in addition to those elements shown in FIGS. 1 through 4 without departing from the scape of the present invention. In particular, unit 10 may be provided with a compressor, an expansion valve, a second heat exchanger and a second fan so that the unit forms a complete vapor compression, refrigeration or air-conditioning system. The air distribution unit may also be provided with controls for the unit itself or various components thereof.

While it is apparent that the invention herein disclosed is well calculated to fulfill the objects previously stated, it will be appreciated that numerous modifications and embodiments may be devised by those sklled in the art, and it is intended that the appended claims cover such modifications and embodiments as fall within the true spirit and scope of the present invention.

What is claimed is:

1. An air distribution unit comprising:

a housing defining an interior, an inlet for conducting air into the interior, and an outlet for discharging air from the interior; and inlet and outlet grilles located in the inlet and outlet, respectively, the inlet and outlet grilles having identical shapes and identical sizes, and each of said grilles having first and second longitudinally extending sides and including i) at least one transverse frame member having first and second legs, the first leg extending from the first longitudinally extending side of the grille to a position generally mid-way along the length of the frame member, and the second leg extending generally from said mid-way position to the second longitudinally extending side of the grille, and ii) a multitude of parallel louvers, each of the louvers having a flat, elongated shape, said multitude of louvers including a first set of louvers rigidly connected to the first leg of the frame member and held in fixed positions relative thereto, and a second set of louvers rigidly connected to the second leg of the frame member and held in fixed positions relative to said second leg;

wherein the inlet grille extends downwardly and rearwardly across the inlet of the housing, and the inlet grille has first and second positions to help direct air into the interior of the housing at first and second inlet angles respectively; and wherein the outlet grille extends forwardly and downwardly across the outlet of the housing, and the outlet grille has first and second positions for directing air from the interior of the housing at first and second outlet angles respectively.

2. An air distribution unit according to claim 1, wherein:

the housing includes first and second edges forming the inlet, and third and fourth edges forming the outlet;

in the first position of the inlet grille, the first and second longitudinally extending sides thereof are respectively located adjacent the first and second edges of the housing;

in the second position of the inlet grille, the first and second longitudinally extending sides thereof are respectively located adjacent the second and first edges of the housing;

in the first position of the outlet grille, the first and second longitudinally extending sides thereof are respectively located adjacent the third and fourth edges of the housing; and in the second position of the outlet grille, the first and second longitudinally extending sides thereof are respectively located adjacent the fourth and third edges of the housing.

3. An air distribution unit according to claim 2, wherein:

the housing includes a multitude of members connected together to define said interior, said multitude of member including a top member, a bottom member and a front member;

the bottom member includes a front edge forming said first edge of the housing;

the front member includes bottom and top edges respectively forming said second and third edges of the housing; and the top member includes a front edge forming said fourth edge of the housing.

4. An air distribution unit according to claim 1 wherein:

the frame member of each of the inlet and outlet grilles has a V-shape;

the first leg of each frame member is linear;

the second leg of each frame member is linear and intersects the first leg of the frame member at an angle greater than 90° and less than 180°;

all of the first set of louvers of each grille form equal, first fixed angles with the first leg of the frame member of the grille;

all of the second set of louvers of each grille form equal, second fixed angles with the second leg of the frame member of the grille; and said first and second angles are different from each other.

5. An air distribution unit according to claim 4, wherein:

said first angle is between 85° and 95°; and said second angle is between 115° and 125°.

6. An air distribution unit according to claim 5, wherein:

said first angle is approximately 90°; and said second angle is approximately 120°.

7. An air distribution unit according to claim 3, wherein:

the front member of the housing has a substantially planar shape;

each of the multitude of louvers of the inlet grille has an outward, termimal edge;

in the first position of the inlet grille, the outward terminal edges of the first set of louvers ot tne inlet grille are substantially co-planar with the front member of the housing; and in the second position of the inlet grille, the outward terminal edges of the second set of louvers of the inlet grille are substantially co-planar with the front member of the housing.

8. An air distribution unit according to claim 1, wherein the frame member of each of the inlet and outlet grilles has a smooth curved shape, and the frame member smoothly curves from the first longitudinal side of the grille to the second longitudinal side thereof.

* * * * *

UNITED STATES PATENT AND TRADEMARK OFFICE

CERTIFICATE OF CORRECTION

PATENT NO. : 5,044,260

DATED : September 3, 1991

INVENTOR(S) : S. Richard Avari

It is certified that error appears in the above-identified patent and that said Letters Patent is hereby corrected as shown below:

Column 1, lines 2-3: "AIR DISTRIBUTION UNITBACKGROUND OF THE INVENTION" should read as --AIR DISTRIBUTION UNIT-- and --Background of the Invention-- should start on line 3. P-2

Column 1, line 6: "commonlY" should read as --commonly--

Column 1, line 11: "tYpe" should read as --type--

Column 3, line 28: memoer" should read as --member--

Column 4, line 23: "d.istribution" should read as --distribution--

Column 6, line 36: "betwecn" should read as --between--

Column 7, line 42: "of.the" should read as --of the--

UNITED STATES PATENT AND TRADEMARK OFFICE

CERTIFICATE OF CORRECTION

PATENT NO. : 5,044,260

DATED : September 3, 1991

INVENTOR(S) : S. Richard Avari

It is certified that error appears in the above-identified patent and that said Letters Patent is hereby corrected as shown below:

Column 8, lines 49-50: after "positions," delete "inlet and outlet grilles located in their first positions,"

Column 9, line 43: "to" should read as --so--

Column 9, line 50: "distributiron" should read as --distribution--

Column 9, line 53: "scape" should read as --scope--

Column 9, line 63: "sklled" should read as --skilled--

Column 9, line 65: "cover such" should read as --cover all such--

Column 12, line 10, Claim 7: "ot tne" should read as --of the--

Signed and Sealed this

Twenty-third Day of February, 1993

*Attest:*

STEPHEN G. KUNIN

*Attesting Officer*

*Acting Commissioner of Patents and Trademarks*